United States Patent [19]

McDonald et al.

[11] 4,034,928

[45] July 12, 1977

[54] METHOD AND APPARATUS FOR PRODUCING CORELESS ROLL ASSEMBLIES OF SEPARABLE BAGS

[75] Inventors: James Anthony McDonald, Palos Heights, Ill.; Robert Wayne Wolfe, Mountain Lakes, N.J.; Walter Theodore Bilik, Tinley Park, Ill.

[73] Assignee: Union Carbide Corporation, New York, N.Y.

[21] Appl. No.: 701,008

[22] Filed: June 29, 1976

[51] Int. Cl.[2] ..... B65H 75/00

[52] U.S. Cl. ..... 242/59; 242/81

[58] Field of Search ..... 242/59, 75.1, 67.1 R, 242/68.2, 68.3, 68.4; 270/69

[56] References Cited

U.S. PATENT DOCUMENTS

| | | | |
|---|---|---|---|
| 2,270,043 | 1/1942 | Fourness | 242/65 X |
| 2,599,942 | 6/1952 | Roen | 242/81 X |
| 3,174,700 | 3/1965 | Lemaire | 242/81 |
| 3,802,639 | 4/1974 | Dowd | 242/81 |
| 3,844,502 | 10/1974 | Toy | 242/67.1 R |
| 3,918,698 | 11/1975 | Coast | 270/69 |
| 3,957,220 | 5/1976 | Beck | 242/59 |

*Primary Examiner*—Edward J. McCarthy
*Attorney, Agent, or Firm*—Cornelius F. O'Brien

[57] ABSTRACT

A method and apparatus for rolling discrete successive sheets of material into a coreless roll assembly comprising means for folding successive sheets of material and guiding and advancing the sheets to a winding station which comprises an axially translatable spindle having ports in its circumferential surface coupled to an air supply. Cooperating with the spindle are translatable belt guide means which substantially circumscribe the spindle so as to guide and aid the advancement of the folded sheets around the spindle, and timing means actuated after a predetermined number of sheets are wound onto the spindle for forcing air out through the ports in the spindle to provide an air bearing layer thereat. The spindle is then axially retracted from the bore of the roll thereby discharging the roll assembly.

23 Claims, 24 Drawing Figures

METHOD AND APPARATUS FOR PRODUCING CORELESS ROLL ASSEMBLIES OF SEPARABLE BAGS

FIELD OF THE INVENTION

The invention relates to an apparatus and method for winding successive separable folded sheets, such as bags, into a self-sustaining coreless roll package in which the sheets can be dispensed from the center of the package one at a time. Specifically, the apparatus employs a novel winding assembly comprising two spaced-apart axially aligned and axially translatable spindles having ports in their circumferential surface adapted for coupling to gas supply means so as to provide a gas bearing layer between the outer surface of the spindles and the inner surface of an innermost or first wound sheet on a roll assembly, and belt guide means cooperating with said spindles for guiding and aiding the advancement of the successively fed sheets around the spindles.

BACKGROUND OF THE INVENTION

It is well known that many people prefer to use inexpensive, disposable paper or plastic bags as a substitute for the conventional cloth or other type reuseable materials for various applications. For example, film and sheet materials made from various plastic polymers, such as polyethylene, polyvinyl chloride, polyesters and the like, and enjoying wide popularity for applications normally reserved for reuseable materials. These materials, even in their film form, are strong, sanitary and relatively inexpensive which lends them well for use as a packaging medium. Consequently, some of the most important uses of plastic film are in the production of wrappers for food, such as sandwich bags, lunch bags, food storage bags and the like. Numerous other important uses have been made of plastic film as, for example, in trash collection, such as wastebasket bags, trash bags and the like, and in dry cleaning stores to cover cleaned suits or dresses. Generally, the latter type plastic bags have been assembled on large dispensing rolls on cores in such a manner that the individual bags are joined to each other along perforated lines that can be relatively easily severed to separate one outermost bag from the roll. However, these rolls are usually large and cumbersome to handle. Recently an improved bag dispenser package was disclosed in pending U.S. application Ser. No. 589,927, titled Bag Dispenser Package, filed June 24, 1975 by J. A. McDonald, which comprises the rolling of separate and discrete bags in sequence into a generally cylindrically shaped coreless roll so that the bags can be removed from the roll one at a time in a sequence starting from the innermost wound bag and proceeding to the outermost wound bag. Although this coreless bag roll assembly is easy to handle and requires a relatively small space for storage, a problem associated with the coreless roll assembly is in providing an apparatus for the automatic and continuous winding of separate bags into coreless rolls.

It is widely known in the art how to roll continuous or separable sheets of material or bags onto cores as disclosed, for example, in U.S. Pat. Nos. 3,387,798, 3,712,554 and 3,844,502. Generally, the leading edge of a continuous sheet or the leading edge of a first sheet is secured to a rotatable core which, upon being rotated, winds the sheet around the core with little or no difficulty. However, to produce a coreless roll assembly, the leading edge cannot be permanently secured to any core or spindle since, in the fully assembled state, the core or spindle has to be removed without disturbing the roll assembly. Although a coreless roll can be assembled by hand, it is the primary object of this invention to provide an apparatus that can automatically assemble discrete sheets, strips or bags into coreless roll assemblies on a continuous basis.

Another object of the invention is to provide an apparatus that can automatically fold a first or leading sheet and then interleave or overlap, a second folded sheet between or superimposed on, respectively, the trailing end portion of the first sheet and so on in sequence, followed by rolling the strand of sheets so arranged into a coreless roll assembly.

Another object of the invention is to provide an apparatus for producing coreless roll assemblies of separable and sequentially wound sheets or bags which employs a winding assembly composed of two spaced-apart axially aligned and axially translatable spindles, each having ports in its circumferential surface adapted for coupling to a gas supply and/or vacuum means, and flexible belt guide means cooperating with the spindles by substantially circumscribing and being urged against the spindles or sheet wound spindles during the winding mode of operation so as to effectively guide and advance the first and successive sheets about said spindles.

Another object of the invention is to provide an apparatus for producing coreless roll assemblies of separable and sequentially wound sheets or bags which employs a pair of driven belt means spaced apart to define a restrictive passage composed of a pair of side walls made up of belt segments of the respective belt means which, in the operation mode of the apparatus, will guide and advance folded strips from the folding station to a winding station of the apparatus.

Another object of the invention is to provide a process for forming a strand of separable folded sheets into a self-sustaining coreless roll assembly.

The foregoing and additional objects will become more fully apparent from the following description and the accompanying drawings.

SUMMARY OF THE INVENTION

This invention broadly relates to an apparatus for rolling discrete and successive sheets of material into a coreless roll assembly comprising tuck-in means adapted for folding successive sheets of material and guiding the folded edge of each successive sheet into a nipper means, said nipper means adapted for guiding and advancing the successively folded sheets of material to a winding means, said winding means comprising an axially translatable spindle having at least one port in its circumferential surface adapted for coupling to a gas supply and, optionally, also vacuum means; translatable guide means adapted for substantially circumscribing said spindle and guiding and aiding the advancement of the successively folded sheets around said spindle; and means operable after a predetermined number of sheets are wound on said spindle for actuating a first means for disengaging said translatable guide means from about said sheet wound spindle, for actuating a second means for forcing gas out through said port in the spindle to provide a gas bearing layer thereat, and for actuating a third means for axially withdrawing the spindle from the bore of the wound sheet assembly thereby producing a coreless roll of successively wound discrete sheets. The winding means of the apparatus may comprise a pair of axially translatable and axially aligned spindles with each spindle having at least one port in its circumferential surface adapted for coupling to a gas supply and, optionally, also vacuum means.

The translatable guide means of this invention may comprise a pair of driven belt means, each of which may comprise a plurality of spaced-apart elastic endless belts driven around shafts which are disposed such that the belts in each belt means are adapted to be urged against and ride about a portion of the circumference of the spindle of the apparatus so that together the belts of both belt means substantially circumscribe the spindle of the apparatus. In the operating mode of the guide means, the driven belts advance and guide the successively fed folded sheets around the spindle of the apparatus to form a roll of successively wound sheets on said spindle. The belt means can then be disengaged from the sheet wound spindle so that the sheet roll assembly can be removed from the spindle as will be described below.

The nipper means of the apparatus may comprise a pair of driven belt means, each of which could comprise a plurality of endless spaced-apart driven belts. The endless belts of one of the driven belt means could be adapted for clockwise rotation while the belts in the other belt means could be adapted for counter-clockwise rotation with each belt means disposed so as to provide a restrictive passage having a first side wall defined by the surfaces of segments of the spaced-apart driven belts of one belt means and a second side wall defined by segments of the spaced-apart driven belts of the other belt means with all the belt segments defining said restrictive passage, moving in the same direction away from the top open end of the passage. Thus when a folded sheet is advanced into the restrictive passage, the moving belt segments will nip the sheet and carry and guide the sheet through said restrictive passage and deliver it to the winding station where the sheet could be wound about the spindle of the apparatus.

The tuck-in means for use in this invention could comprise a reciprocable knife member disposed above the open end of the restrictive passage of the nipper means and operable such that when a sheet is positioned over the open end of the passage, the knife member would advance and contact the sheet somewhat between its extremities and proceed to fold said sheet about the contact area. The knife upon further advancement will project the folded edge of the sheet so formed into the open end of the restrictive passage of the nipper means where the sheet will be nipped, guided and advanced to the winding station of the apparatus. If desired, the tuck-in means could comprise an air jet ejector of the type as disclosed in U.S. Pat. No. 3,918,698 to John B. Coast.

The invention also relates to a method of forming a self-sustaining coreless roll package of serially wound sheets, comprising the steps:

a. folding a first and then successive sheets between their outer edge extremities and advancing and guiding the folded end of said first and succeeding sheets to a roll winding station;
b. guiding and rolling said first and successive sheets about an axially translatable spindle into a roll of separable folded sheets;
c. pressurizing the interface of the outer surface of the spindle and the inner surface of the innermost wound sheet; and
d. removing the spindle from the bore of the roll.

The invention also relates to another method for forming a strand of separable folded sheets into a self-sustaining coreless roll package in which the serially wound sheets can be dispensed from the center of the roll one at a time comprising the steps:

a. folding a first sheet between its outer edge extremities and advancing the folded end of said first sheet to a roll winding station;
b. folding a second sheet between its outer edge extremities and overlapping the folded end of the second sheet a unitary distance on at least one of the trailing end portions of said folded first sheet to form an overlapping arrangement;
c. folding, advancing and overlapping a predetermined number of succeeding sheets in a like manner into a strand of sheets;
d. guiding and rolling said strand about an axially translatable spindle into a roll of separable overlapped folded sheets;
e. pressurizing the interface of the outer surface of the spindle and the inner surface of the innermost wound sheet; and
f. removing the spindle from the bore of the roll thereby producing a coreless roll of overlapped sheets.

Step (c) of the above method could be modified such that the terminal sheet overlaps one of the trailing ends of the preceding sheet a distance greater than the overlapped distance between the first and second sheets, with the sheets intermediate the terminal and second sheets being overlapped incrementally increasing distances from the inner wound sheets to the outer wound sheets.

An alternate modification of step (c) would be that after a first predetermined number of succeeding sheets is overlapped to form a first strand portion, the following substeps are added:

c'. folding, advancing and interleaving a succeeding sheet between the trailing end portions of the last sheet in the first strand portion; and
c''. folding, advancing and interleaving a second predetermined number of succeeding sheets in a like manner to form a second strand portion.

Substeps (c') and (c'') could be further modified such that in step (c') the terminal sheet of the first predetermined number of sheets overlaps at least one of the trailing ends of the preceding sheet a distance greater than the overlapped distance between the first and second sheets in said first strand portion, with the sheets intermediate the terminal and second sheets in said first strand portion being overlapped incrementally increasing distances from the inner wound sheets to the outer wound sheets in said first strand portion; and in step (c'') the terminal sheet of the second predetermined number of sheets is interleaved into the trailing ends of the preceding sheet a distance greater than the interleaved distance between the first and second sheets in said second strand portion, with the sheets intermediate the terminal and second sheets in said second strand portion being interleaved incrementally increasing distances from the inner wound sheets to the outer wound sheets in said second strand portion.

The invention also relates to another method of forming a strand of separable folded sheets into a self-sustaining coreless roll package in which the serially would sheet can be dispensed from the center of the roll one at a time comprising the steps:

a. folding a first sheet between its edge extremities and advancing the folded end of said first sheet into a roll winding station;
b. folding a second sheet between its edge extremities and interleaving the second folded end of the second sheet a unitary distance between the trailing end portions of said folded first sheet to form an interleaved arrangement of sheets;
c. advancing, folding and interleaving a predetermined number of succeeding sheets in a like manner into a strand of sheets;
d. guiding and rolling said strand about an axially translatable spindle at a constant tension into a roll of separable interleaved folded sheets;
e. pressurizing the interface of the outer surface of the spindle and the inner surface of the innermost wound sheet; and
f. removing the spindle from the bore of the roll.

Step (c) of the above method could be modified such that the terminal sheet is interleaved between the trailing ends of the preceding sheet a distance greater than the interleaved distance between the first and second sheets, with the sheets intermediate the terminal and second sheets being interleaved incrementally increasing distances from the inner sheet to the outer wound sheet.

As used herein, the term "sheet" shall mean a continuous strip, a separable strip, a bag, a longitudinally folded continuous strip, a longitudinally separable strip, a longitudinally folded bag, and the like.

As used herein, the term "spindle" shall mean a single unitary shaft or a pair of axially aligned shafts or split shaft(s).

BRIEF DESCRIPTION OF THE DRAWINGS

The present invention will become apparent from the following description thereof when considered together with the accompanying drawings which are set forth as being exemplary of embodiments of the present invention and are not intended, in any way, to be limitative thereof and wherein.

DETAILED DESCRIPTION

Figure 1:
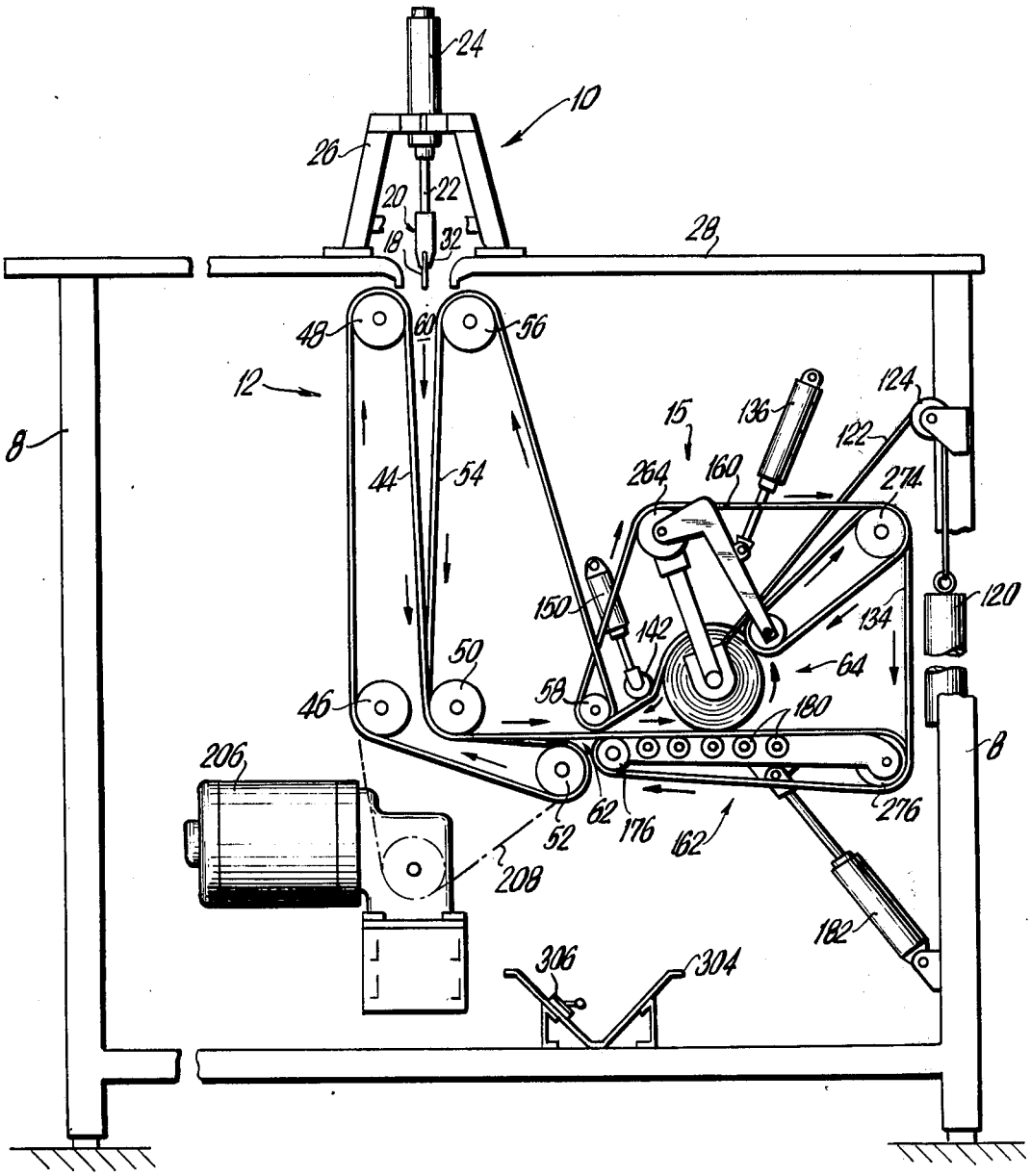
FIG. 1 is a schematic illustration of a coreless roll winding apparatus of this invention showing a completed assembly of a roll of bags on the spindle of the apparatus.
Figure 2:
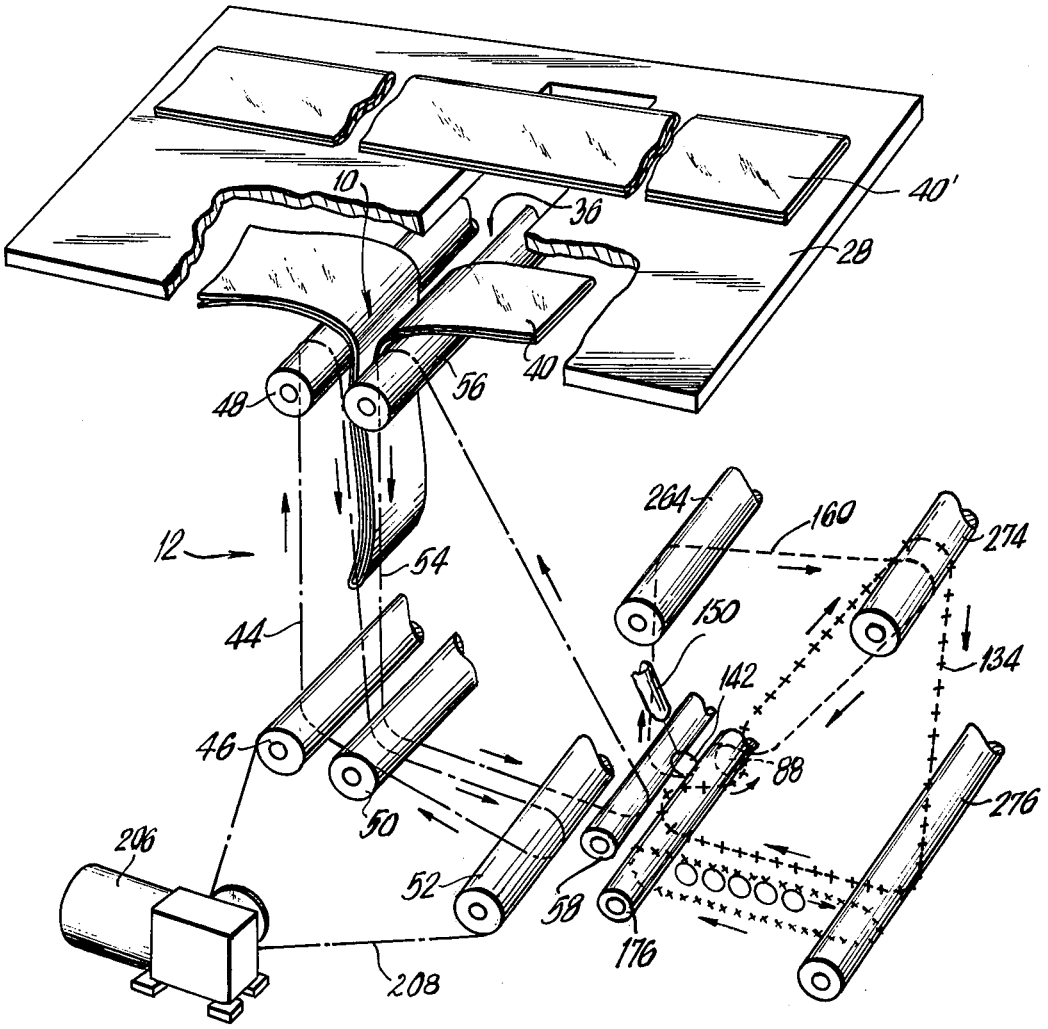
FIG. 2 is a fragmentary perspective view of the coreless winding apparatus shown in FIG. 1.
Figure 3:
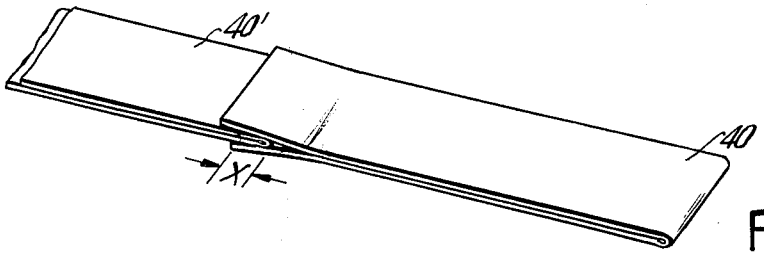
FIG. 3 is a perspective view of a folded bag having its folded end interleaved between the trailing ends of a preceding bag.
Figure 3A:
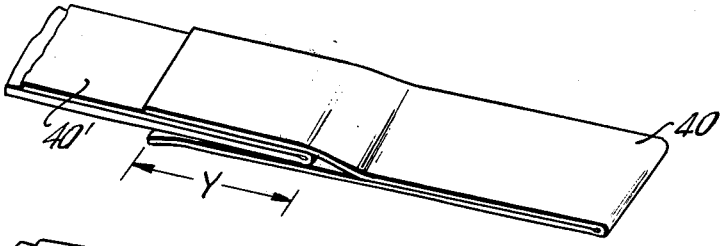
FIG. 3*a* is a view of an interleaved bag arrangement as shown in FIG. 3 with the exception that the interleaved distance is greater than that shown in FIG. 3.
Figure 5:
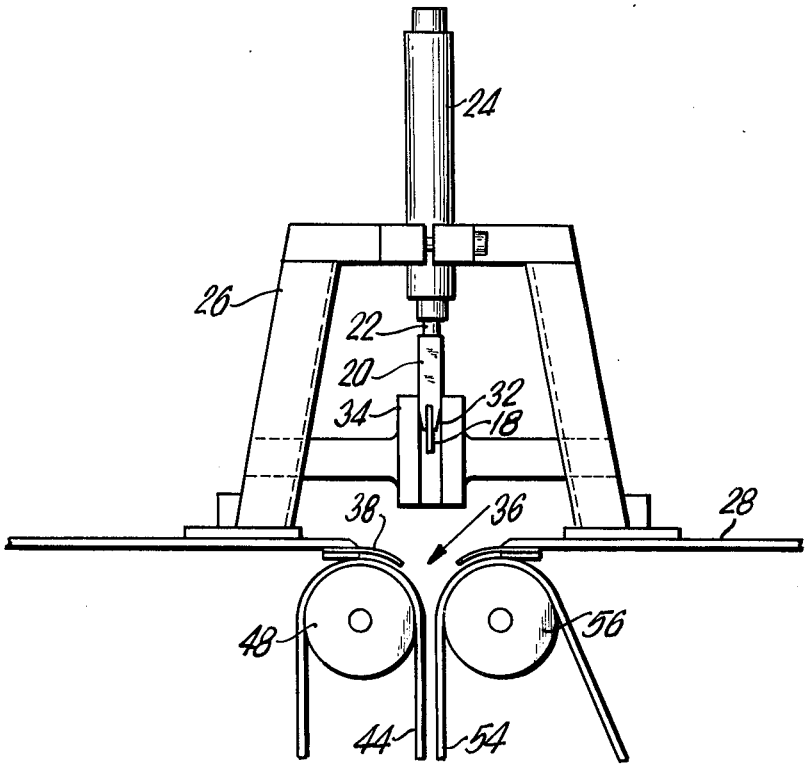
FIG. 5 is an enlarged side elevational view of the tuck-in knife means in retracted mode and related components of the coreless roll winding apparatus shown in FIG. 1.
Figure 6:
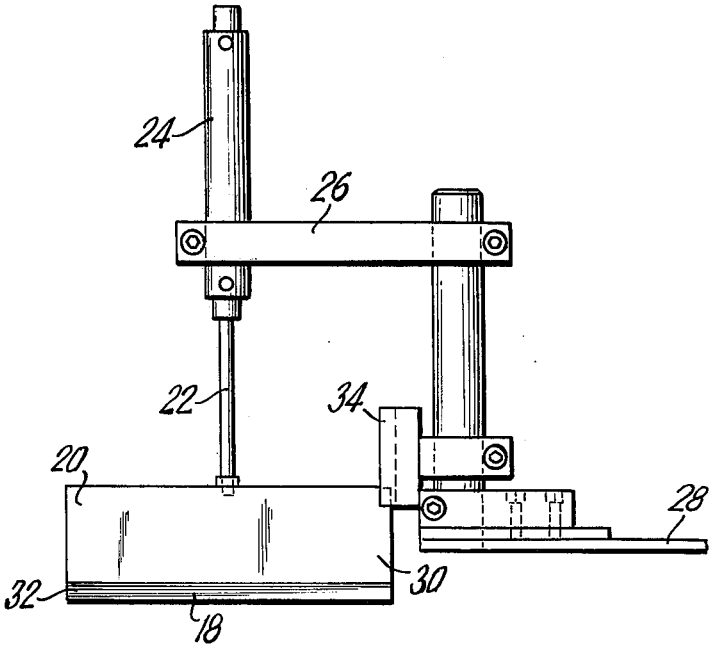
FIG. 6 is an end view of the tuck-in knife means shown in FIG. 5 in advanced mode.

In FIGS. 1 and 2 there is shown a coreless roll winding apparatus comprising frame 8 mounting a sheet folding station designated as 10, a guiding and delivering station designated as 12, and a bag roll forming station designated as 15. As shown in FIGS. 1, 5 and 6, bag folding station 10 comprises a sheet tuck-in means such as an elongated blade 18 mounted in the tapered end 32 of holder 20 which in turn is centrally secured to piston rod 22 of pneumatic cylinder 24. Pneumatic cylinder 24 is adjustably secured to frame 26 which in turn is secured to platform 28. As shown in FIGS. 5 and 6, the side end edge 30 of blade holder 20 is adapted for sliding in vertical guide block 34 thereby insuring that the blade 18 will maintain proper alignment midway between throat 36 defined by curved guide plates 38 secured to platform 28 as shown in FIG. 5. In the operational mode of the sheet folding station 10, a sheet, such as a bag 40 as shown in FIG. 2, is placed on platform 28 and positioned over throat 36. The pneumatic cylinder 24 is activated thereby advancing blade 18 into contact with bag 40 approximately midway between its terminal edges whereupon bag 40 begins to fold about the blade contact edge. The blade 20 is further advanced downwardly thereby projecting the folded end of the bag 40 into and through throat 36 where it is guided and advanced to bag roll forming station 15 as will be discussed below. To provide a strand of interleaved bags 40 as shown in FIG. 3, after the first bag is substantially projected through throat 36 as shown in FIG. 2, the succeeding bag 40' is positioned over throat 36 while the trailing ends of bag 40 are still spanning throat 36. Activation of pneumatic cylinder 24 will contact and force the folded end of the succeeding bag 40' between the trailing end portions of bag 40 for a distance X as shown in FIG. 3. It is understood that if bag 40' was advanced over throat 36 while the trailing ends of bag 40 were further extended on platform 28, then the interleaved distance of the bags 40 and 40' would be increased to Y as shown in FIG. 3*a*.

Figure 3B:
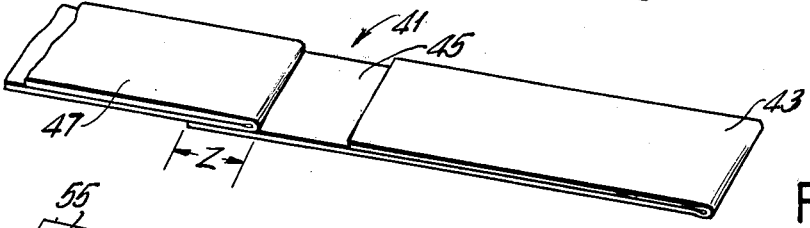
FIG. 3*b* is a perspective view of a folded bag having its folded end overlapped onto one of the trailing ends of a preceding bag.
Figure 3C:
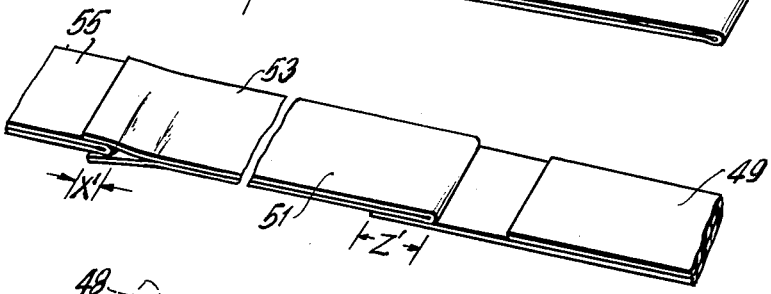
FIG. 3*c* is a perspective view of a segment of a strand of folded bags wherein the initial portion of the strand has adjacent bags in an overlapping arrangement as shown in FIG. 3*b* and the latter portion of the strand has adjacent bags in an interleaved arrangement as shown in FIGS. 3 and 3*a;*

To provide a strand of overlapping bags 41 as shown in FIG. 3*b*, then the first bag 43 is folded off center to provide an extended trailing end 45 remaining on platform 28 when the succeeding bag 47 is positioned over throat 36. Activation of pneumatic cylinder 24 will contact and force the folded end of the succeeding bag 47 on top of the trailing end 45 of bag 43 a distance of Z as shown in FIG. 3*b*. It should be obvious that by adjusting the orientation of the bags with respect to the tuck-in means, a strand of bags could be produced as shown in FIG. 3*c* in which bags 49 and 51 are overlapped by a distance Z' in the initial portion of the strand while bags 53 and 55 in the latter portion of the strand are interleaved a distance X'. It is to be understood that the bags could also be fed to the tuck-in means in a manner such that each succeeding bag would not contact the preceding bag thereby providing a chain of unconnected bags which could be wound one on top of the other to provide a roll assembly.

As shown in FIGS. 1 and 2, the guiding and delivering station 12 comprises a first group of a plurality of spaced-apart endless delivery belts 44 (only one belt is shown for clarity of illustration) trained about driven lower roller 46, upper roller 48, driven roller 50 and outboard roller 52, and a second group of a plurality of spaced-apart endless delivery belts 54 (again, only one belt shown for clarity of illustration) trained about driven roller 50, upper roller 56 and combination roller 58. The two groups of delivery belts 44 and 54 are laterally displaced so as to form a vertically disposed tapered restrictive passage 60 abruptly terminating in a horizontal restrictive passage 62. The spaced-apart belts 44 and 54 of each group are axially displaced or offset so that each belt can ride in its own circumferentially disposed path on driven roller 50. Delivery belts 44 are adapted for clockwise rotation about pulleys 46, 48, 52, while delivery belts 54 are adapted for counterclockwise rotation about pulleys 50, 56, 58 so that restrictive passage 60 is defined by side walls made up of substantially vertically disposed segments of belts 44 and 54 moving in a downward direction. In the operational mode of the guiding and delivering at station 12, a folded sheet, such as a folded bag 40 as shown in FIG. 2, is advanced or inserted into the open end of restrictive passage 60 from the folding station 10, where it is nipped by belts 44 and 54 and guided and advanced through passage 60. At the lower end of passage 60, the advancing bag is directed around driven roller 50 and carried and guided by belts 44 and 54 through horizontal passage 62 whereupon the bag is then advanced to the roll forming station 15.

Figure 7:
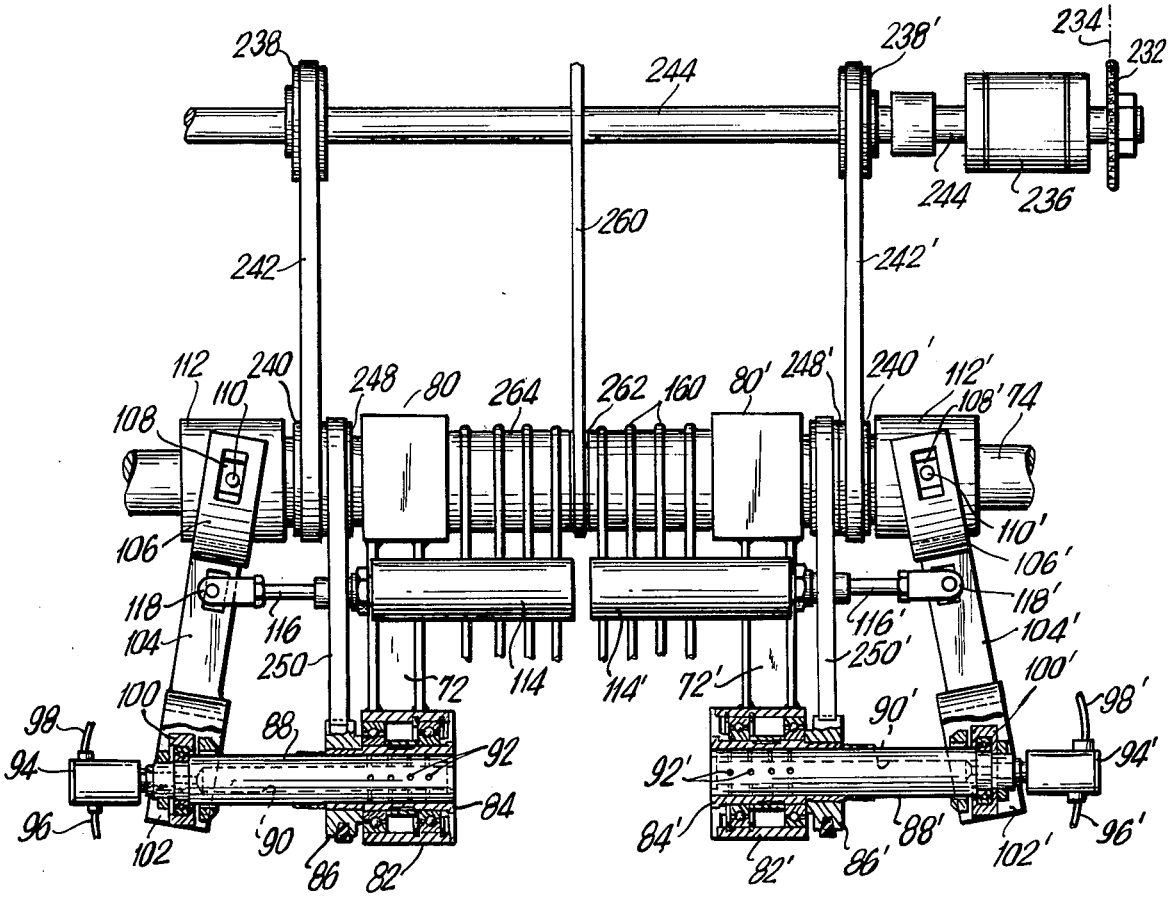
FIG. 7 is an enlarged side elevational view of the spindle assembly of the coreless roll winding apparatus shown in FIG. 1, with the spindle in a roll discharging or doffing mode.
Figure 8A:
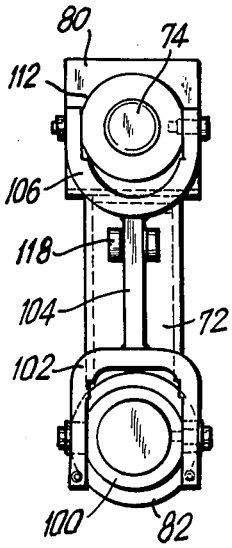
FIG. 8*a* is an end view taken along 8*a*—8*a* of FIG. 8 with the pivot arm member 72 shown vertically disposed.
Figure 8:
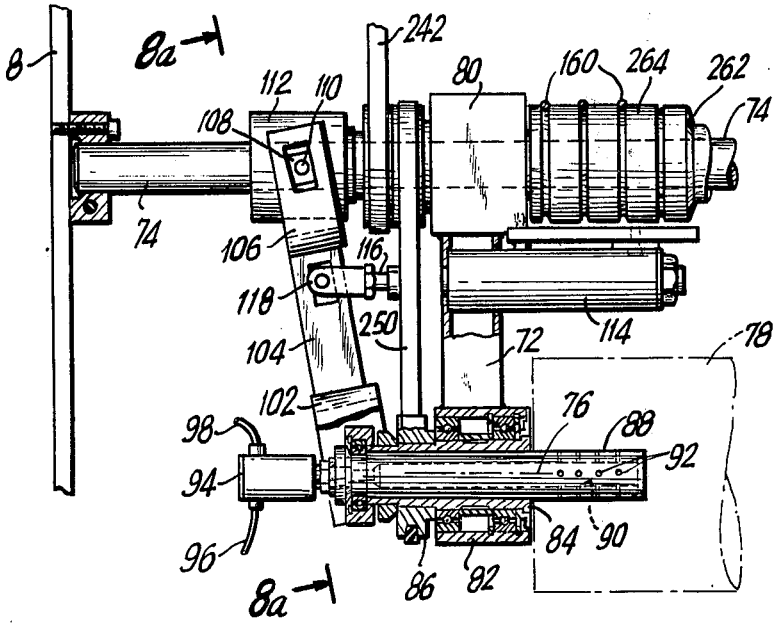
FIG. 8 is a portion of the side elevational view of FIG. 7 showing the spindle in a roll winding mode.

As shown in FIGS. 1 and 2, roll forming station 15 basically comprises a roll forming means, such as a center wind spindle assembly 64, translatable guide means such as cooperatively working inboard lacing roller 142 and crossover lacing roller 132 with their respective elastic endless belts, and roll support and doffing cradle 162. FIGS. 7, 8 and 8*a* show an enlarged view of the center wind spindle assembly 64 comprising a pair of opposite hand pivot arms members 72, 72' symmetrically pivotally mounted on pivot shaft 74 about centerline 76 of a bag roll 78 shown by broken lines in FIG. 8. Since the mandrel assembly 64 is basically symmetrical, the description of only the left half of the assembly 64 will be discussed with the corresponding symmetrical components on the other half of assembly 64 being identified by corresponding prime reference numbers in brackets. Pivot arm 72 (72') has an inboard pivot 80 (80') and an outboard slide bearing block 82 (82') rotatably mounting sleeve 84 (84') secured to timing belt sprocket 86 (86'). Sleeve 84 (84') is slideably keyed to spindle 88 (88'). Spindle 88 (88') has a central passage 90 (90') and an outer tapered surface at its sheet gripping end provided with a plurality of ports 92 (92') for passing gas or vacuum from passage 90 (90') to the surface of the sheet gripping or first end of said spindle 88 (88'). Passage 90 (90') terminates at the second end of the spindle 88 (88') in a rotatable pneunatic coupling 94 (94') connected to a supply of compressed gas 96 (96') or, optionally, to alternatively supplied sources of compressed gas 96 (96') and vacuum 98 (98') as will be described below.

Adjacent its second end, spindle 88 (88') is rotatably secured within cap bearing 100 (100') which is secured to the outboard clevis end 102 (102') of swing arm 104 (104'). The inboard clevis end 106 (106') of swing arm 104 (104') is slideably secured by crosshead blocks 108 (108') rotatably mounted in pins 110 (110') secured to collar 112 (112'). Collar 112 (112') is rotatably secured to spindle pivot shaft 74. A single acting pneumatic cylinder 114 (114') is secured to pivot arm 72 (72') with its piston rod 116 (116') pivotably secured to swing arm 104 (104') by clevis 118 (118'). When both cylinders 114, 114' are simultaneously activated, they successively advance and retract spindles 88, 88' to and from sleeves 84, 84' to provide the doffing mode as shown in FIG. 7 and the winding mode as partially shown in FIG. 8, respectively. As shown in FIG. 1, the entire spindle assembly is counterbalanced by weight 120 connected via cable 122 which passes over pulley 124 and is attached to outboard bearing block 82 (82'). A degree of counterbalancing force for the weight of pivot arm 72 is supplied by weight 120 and is preferably selected to lightly urge spindle 88 (88') to engage the inboard lacing belts 160 as shown in FIG. 1.

Figure 9:
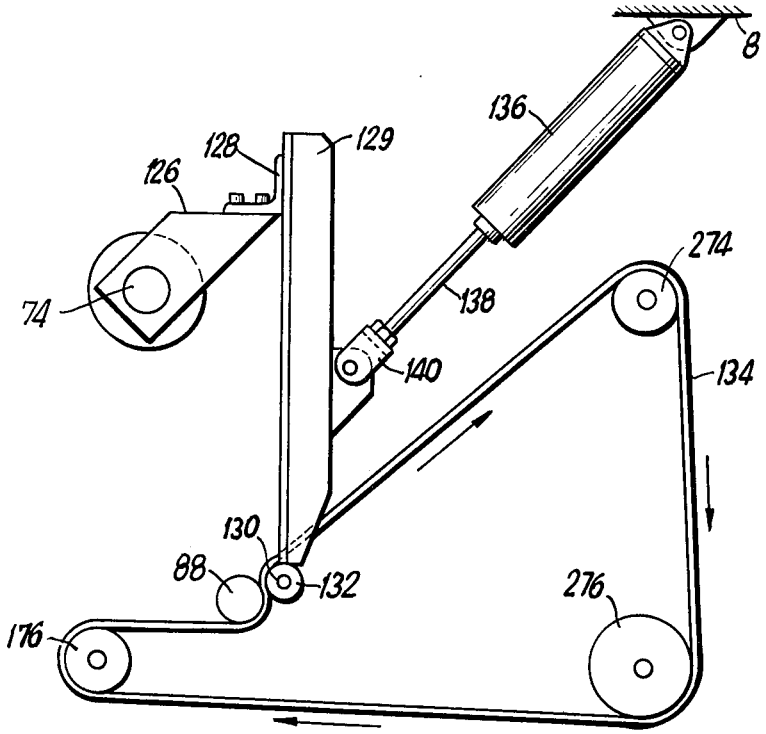
FIG. 9 is an enlarged end elevational view of the crossover roller means and related components of the coreless roll winding apparatus of FIG. 1.
Figure 10:
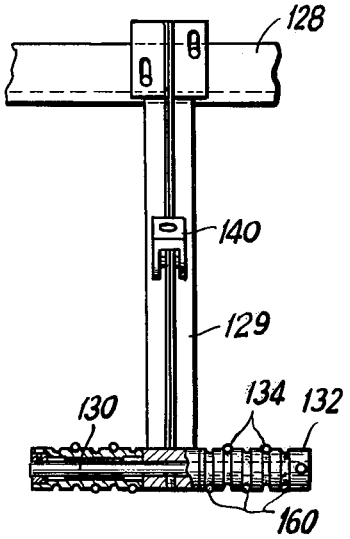
FIG. 10 is the side view of the crossover roller of FIG. 9.
Figure 11:
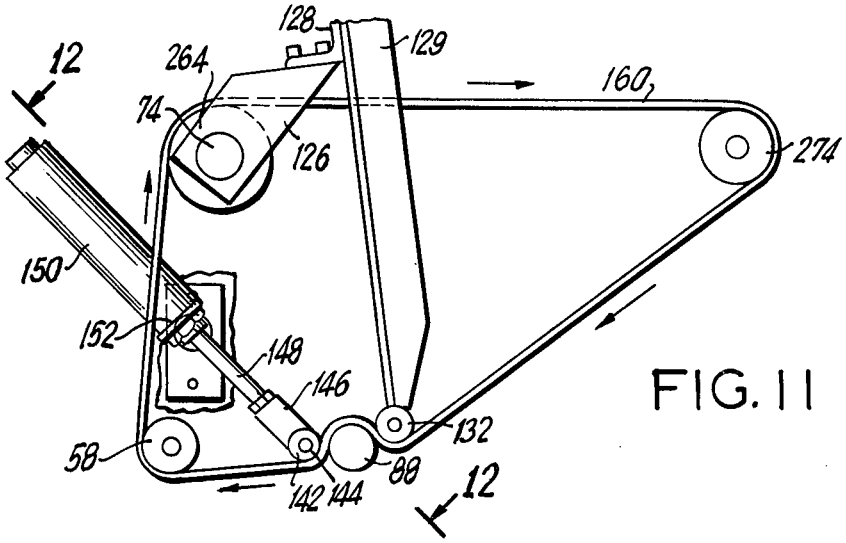
FIG. 11 is an enlarged end elevational view of the inboard guide roller means of the coreless roll winding apparatus of FIG. 1.

As shown in FIGS. 9 and 10, crossover lacing guide belt means comprises a pair of pivot blocks 126 (only one shown) rotatably pivoted on spindle pivot shaft 74 by conventional means. One of the blocks 126 is positioned outboard of swing arm collar 112 and the other is positioned outboard of swing arm collar 112', said swing arm collars being shown in FIG. 7. Cross member 128 is secured at each end to the blocks 126 and centrally mounts roller bracket 129 which in turn centrally secures roller shaft 130. Roller shaft 130 has grooved crossover lacing guide roller 132 rotatably secured thereon for guiding a plurality of outboard winding and guiding endless elastic belts 134 in crossover relation with inboard winding and guiding endless elastic belts 160 as shown in FIGS. 1, 2 and 11. Roller 132 via bracket 129 is selectively pivotally moved into and away from the roll winding spindle 88 for the roll winding and roll doffing modes, respectively, by pneumatic cylinder 136. The head end of cylinder 136 is pivotally secured to frame 8 and the piston rod 138 is pivotally secured to bracket 129 by clevis 140. Endless elastic belts 134 are trained about drive roller 274, cradle trunnion roller 276, cradle idler roller 176 and roller 132 such that in the roll winding mode of the apparatus the belts 134 initially ride upon a surface segment of spindles 88 so as to advance and guide the initial sheet being fed to the winding station around said spindles 88. The belts 134 will thereafter ride upon a surface segment of the outermost wound sheet on the spindles 88 so as to advance and guide succeeding sheets initially around and over the underlying rolled sheets.

Figure 12:
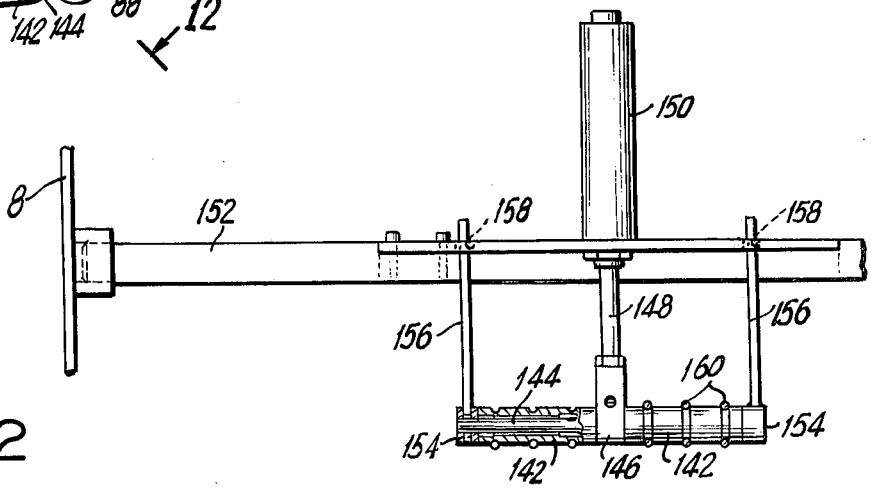
FIG. 12 is a side elevational view of the inboard guide roller taken along line 12—12 of FIG. 11.
Figure 20:
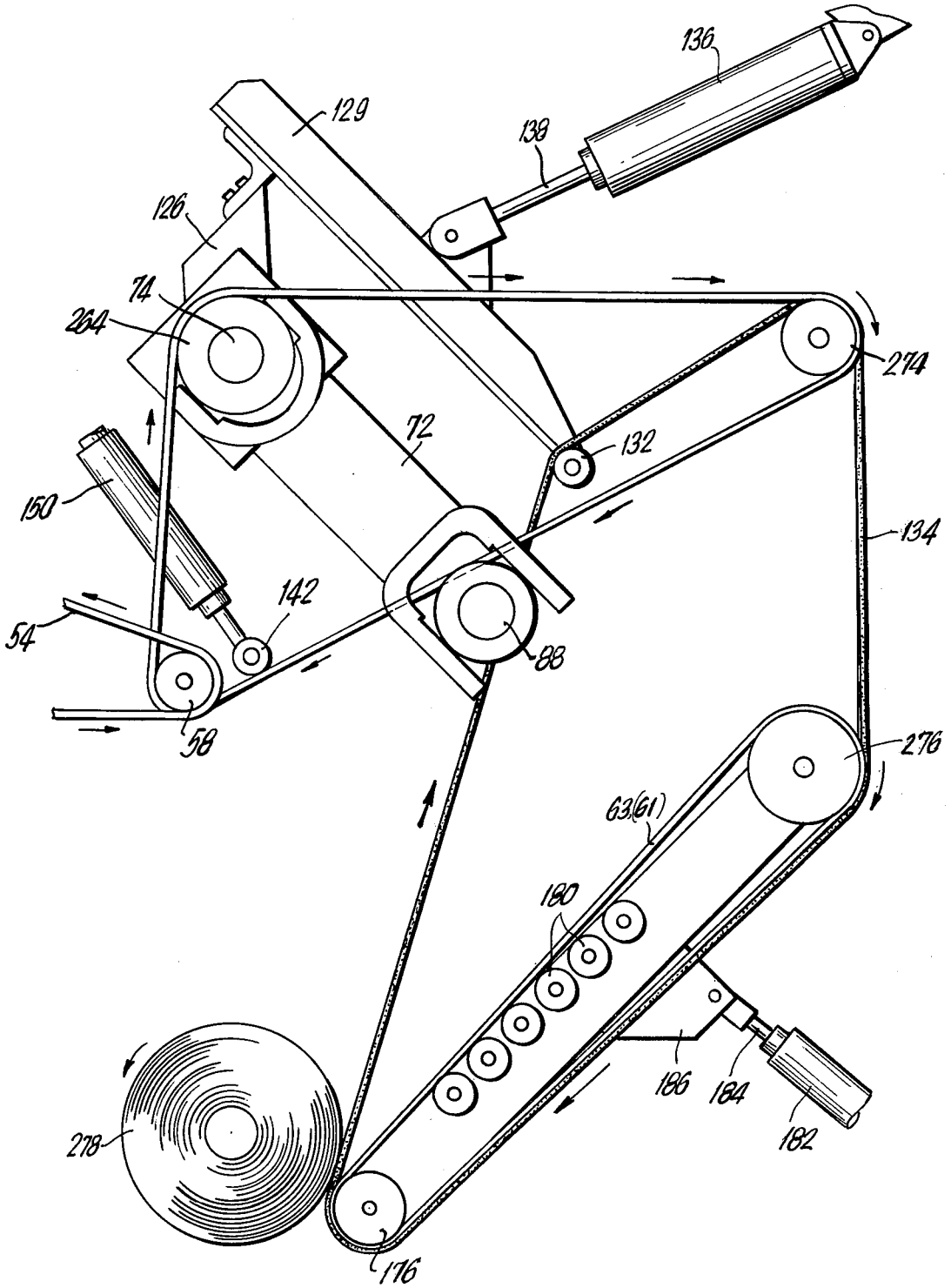
FIG. 20 is an enlarged end view of the winding spindle and related guide means shown just after a coreless roll assembly has been discharged from the spindle.

As shown in FIGS. 11 and 12, the inboard lacing guide belt means comprises grooved rollers 142 rotatably mounted on shaft 144 that is centrally secured in clamp 146 which in turn is secured to piston rod 148 of pneumatic cylinder 150. Pneumatic cylinder 150 is fixedly secured to cross member 152 which in turn is adjustably secured to frame 8. Collars 154 secured to the outboard end of shaft 144 retain grooved belt rollers 142 and are fastened to the outboard end of guide rod 156. The inboard ends of guide rods 156 are slideably fitted in slots 158 of cross member 152 to serve as antirotational means when cylinder 150 is activated to advance and retract grooved rollers 142 toward and away from, respectively, the spindles 88. A plurality of spaced-apart inboard winding and guiding endless elastic belts 160 is trained about roller 274, drive roller 264, combination roller 58, roller 142 and roller 132 such that in the winding mode of the apparatus, the belts 160 initially ride upon a surface segment of spindles 88 so as to advance and guide the initial sheet being fed from the crossover lacing guide belt means around the spindles 88. The belts 160 will thereafter ride upon a surface segment of the outermost wound sheet on the spindles so as to advance and guide succeeding sheets around and over the underlying rolled sheets. The outboard endless belts 134 are laterally displaced from the inboard endless belts 160 such that they all are trained about driven roller 274 and crossover lacing roller 132 as shown in FIGS. 1 and 2. The cooperative arrangement of belts 134 and belts 160 effectively substantially circumscribes spindles 88, 88' so that in the winding mode of the apparatus, the belts guide and aid the advancement of the first and succeeding sheets substantially about spindles 88, 88' thereby insuring that the sheets are wound into a roll assembly. Thus the center winding provided by spindles 88, 88' is supplemented by surface winding provided by belts 134 and 160 thereby maintaining a desirable alignment of the sheets on the roll while also effectively aiding in maintaining a constant tension during the rolling of the sheets. Upon completion of rolling a desired number of sheets, the belts 134 and 160 are disengaged from the sheet or bag roll spindles 88, 88' so as to allow the sheet or bag roll assembly to be discharged from the spindles 88, 88' as shown in FIG. 20.

Figure 13:
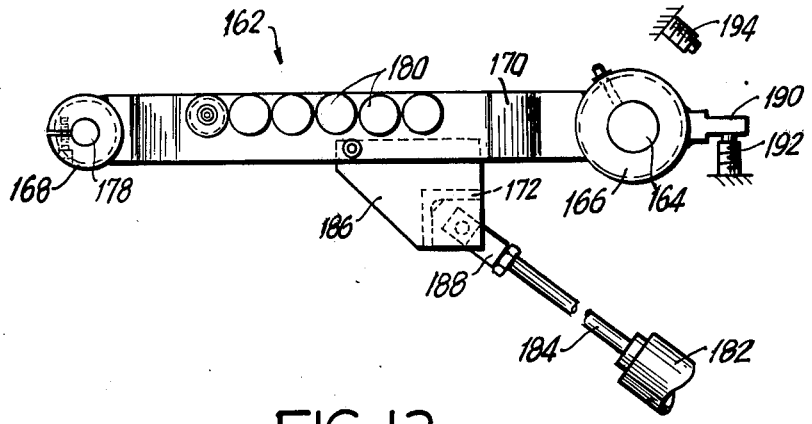
FIG. 13 is an enlarged end elevational view of the cradle means of the coreless roll winding apparatus of FIG. 1.
Figure 14:
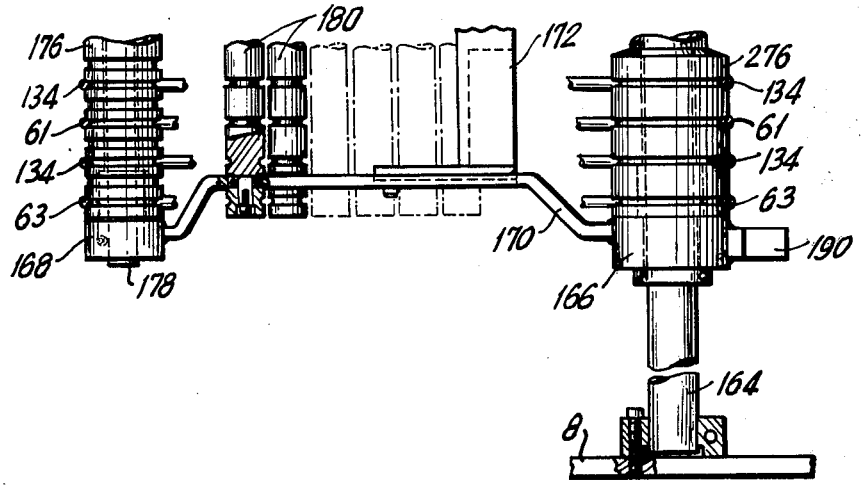
FIG. 14 is a plan view of a part of the cradle means shown in FIG. 13.

As shown in FIGS. 13 and 14, roll support cradle means comprises a pivotable cradle 162 mounted on trunnion shaft 164 fixedly secured to frame 8. Inboard bearing blocks 166 (only one shown) trunnioned on shaft 164 and outboard collars 168 (only one shown) are connected to form a roller mounting frame by side members 170 (only one shown) and cross member 172. Inboard belt roller 276 is rotatably mounted on shaft 164 and outboard belt roller 176 is rotatably mounted on shaft 178 secured in collar 168. Support rollers 180 are rotatably secured in side members 170 to progressively support the sheet roll assembly as it increases in size. Roll support cradle 162 is provided with a plurality of endless round belts 61 and a pair of round drive belts 63, spaced apart, laterally displaced from belts 134 and trained about cradle trunnion roller 276, idler roller 176 and supported on the tops of belt support rollers 180. The cradle 162 is selectively pivotably moved into the roll winding and roll doffing modes by pneumatic cylinder 182. The head end of cylinder 182 is pivotally secured to frame 8 (not shown) and the piston rod 184 is pivotally secured to cross member bracket 186 by clevis 188. Indexing of the cradle 162 to the raised and lowered position is controlled by tongue 190 projecting from bearing block 166 which engages either the indexing stop 192 for the roll winding position or stop 194 for the roll doffing position, both stops 192 and 194 being secured to frame 8 by conventional cross mounting brackets not shown. Indexing stop 192 is preferably adjusted to provide nipping engagement of the belts on roller 176 with the belts on roller 58 at the start of the roll winding cycle. The cradle 162 is shown in the roll winding position in FIG. 18 and in the doffing position in FIG. 20.

Figure 15:
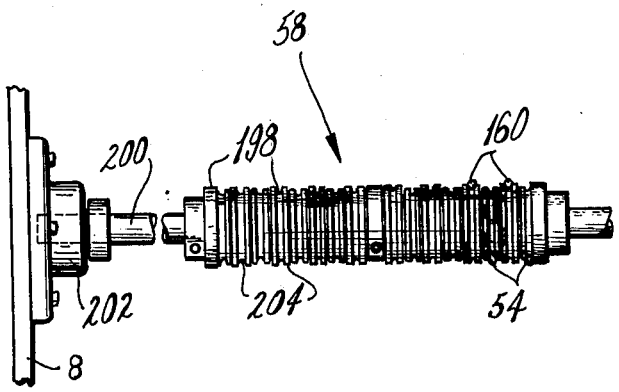
FIG. 15 is an enlarged plan view of the combination roller 58 shown in FIG. 1.
Figure 16:
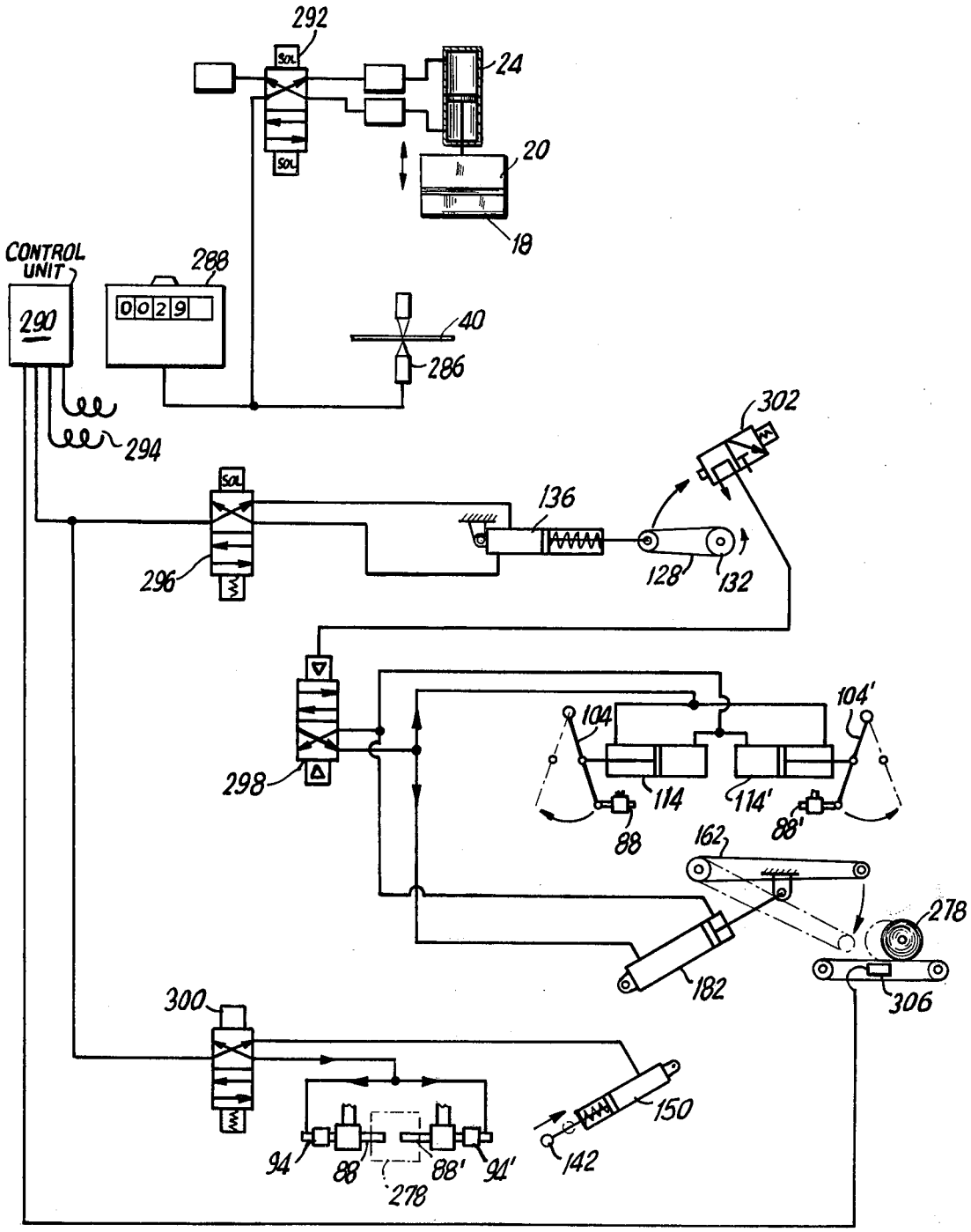
FIG. 16 is a schematic view of the pneumatic control means for the coreless roll winding apparatus of FIG. 1.

Combination roller 58 is shown in FIG. 15 and accommodates both the inboard winding belts 160 and the guide and delivery belts 54. Specifically, combination roller 58 comprises spaced apart grooved pulleys 198 fixed to shaft 200 rotatably mounted in bearings 202 secured to frame 8. Spaced apart delivery belts 54 drive pulleys 198 and shaft 200 in a counter-clockwise direction. Spaced-apart idler pulleys 204 are laterally displaced intermediate pulleys 198 and are provided with bushings (not shown) so as to freely rotate on shaft 200. Inboard winding belts 160 drive idler pulleys 204 in a clockwise direction.

Figure 4:
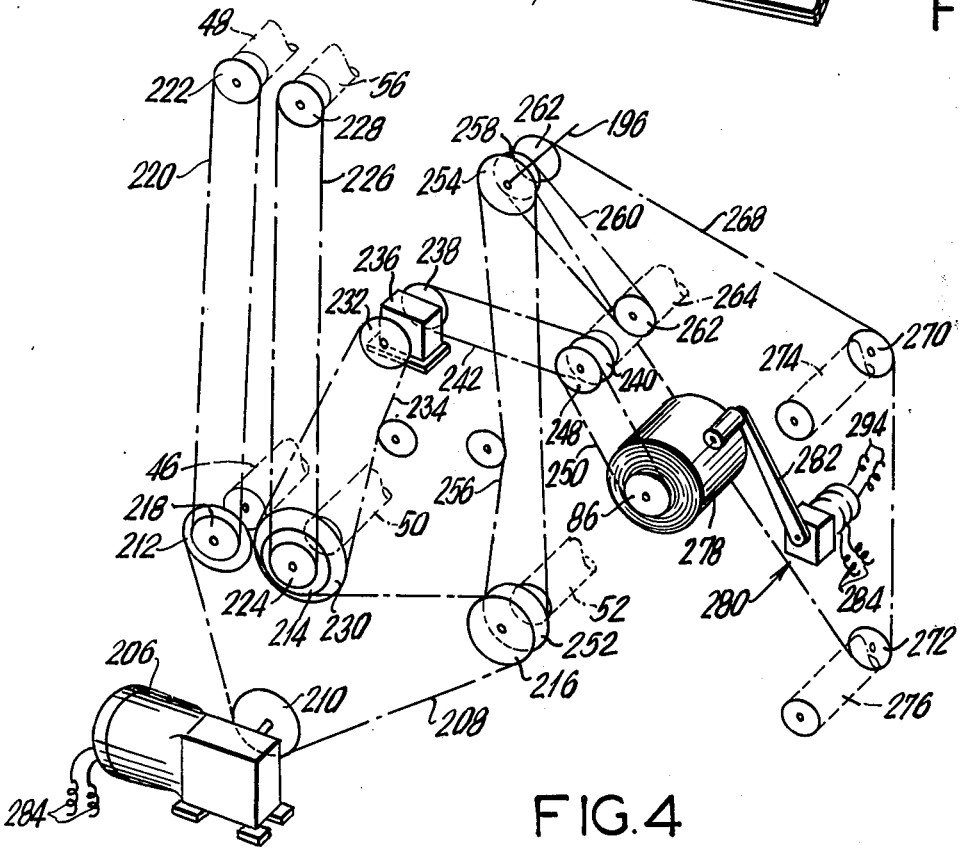
FIG. 4 is a schematic perspective view of the driving means for the coreless roll winding apparatus of FIG. 1.

A schematic of the driving means for the coreless winding apparatus is shown in FIG. 4 wherein a d-c variable speed gearmotor 206 drives roller chain 208 via sprocket 210 which in turn drives sprockets 212, 214 and 216 coupled to rollers 46, 50 and 52, respectively, shown in FIGS. 1 and 2. Coupled to roller 46 is sprocket 218 which via roller chain 220 drives roller 48 via sprocket 222. Coupled to roller 50 is sprocket 224 which via roller chain 226 drives roller 56 via sprocket 228. Also connected to roller 50 is sprocket 230 which drives sprocket 232 via roller chain 234. Sprocket 232 is coupled to an input shaft (not shown) of a variable flux magnetic clutch 236 having an output shaft 244 (FIG. 7) coupled to sprocket 238 which in turn drives sprocket 240 via timing belt 242. As shown in FIG. 7, the output shaft 244 drives spindle drive sprockets 240 (240') via timing belt 242 (242'), said spindle drive sprockets 240 (240') being rotatably mounted on shaft 74. Timing belt sprockets 248 (248') are coupled to sprockets 240 (240') and by timing belt 250 (250') sprockets 248 (248') drive sprockets 86 (86') coupled to spindles 88, 88'. Thus by this timing belt and sprocket arrangement, the variable flux magnetic clutch 236 is able to be adjusted for example, by potentiometer 280, to provide a variable torque that will effectively provide constant tension to the sheets as they are being wound on spindles 88, 88'.

Figure 19:
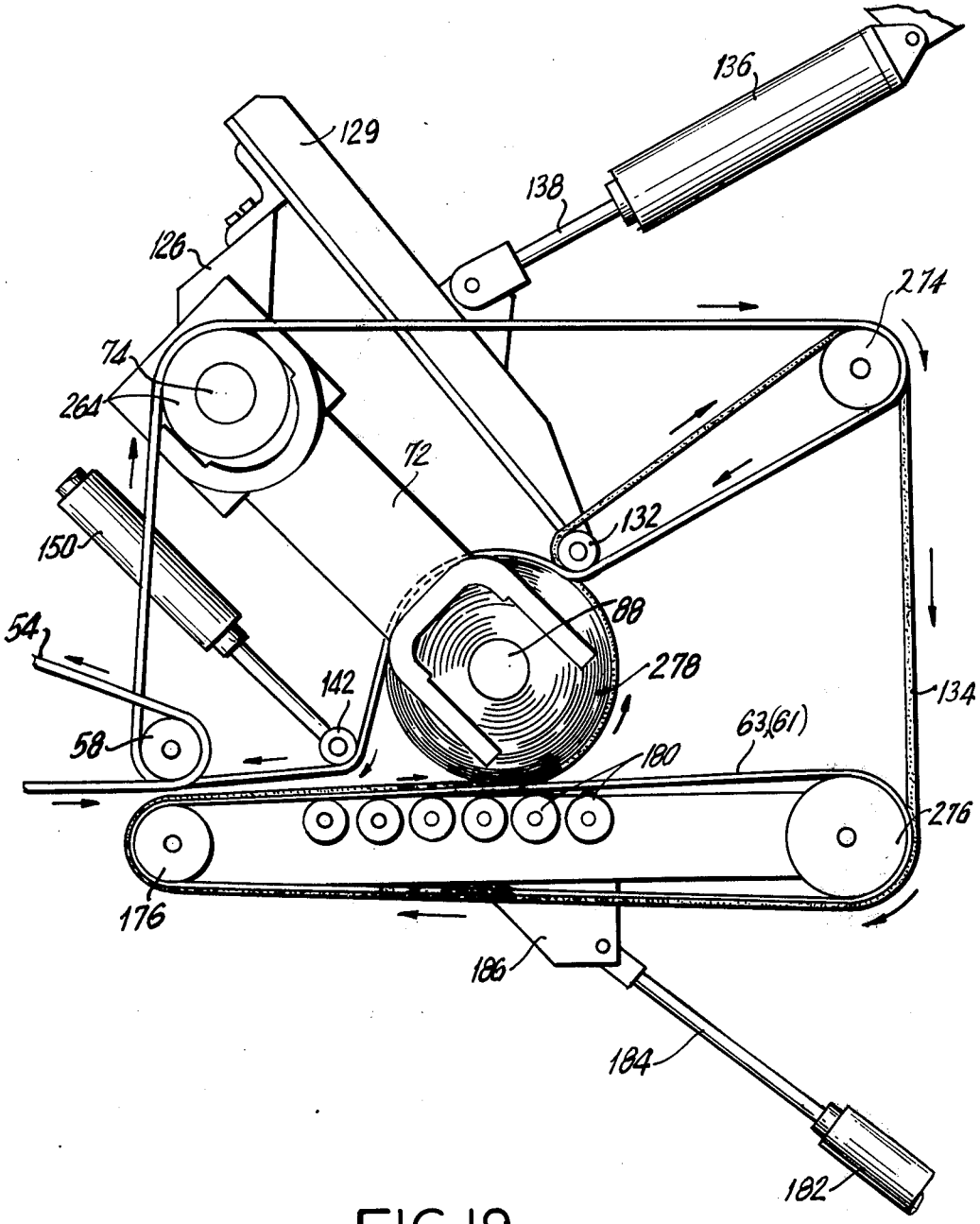
FIG. 19 is an enlarged end view of the winding spindle and related guide means shown just as the completion of winding a successive series of bags on the spindle.

Sprockets 216 is coupled to sprocket 252 which drives sprocket 254 via roller chain 256. Sprocket 254 in turn is coupled to sheave 258 via countershaft 196 which via V-belt 260 drives sheave 262 centrally secured to roller 264. Roller 264 is rotatably mounted on spindle pivot shaft 74, and which drives inboard belts 160 as shown in FIG. 11. Coupled to countershaft 196 is sprocket 262 which drives via roller chain 268 sprockets 270 and 272 coupled to rollers 274 and 276, respectively, said rollers 274 and 276 driving outboard belts 134 as shown in FIG. 19.

Also included in the schematic diagram of FIG. 4 is a sheet roll assembly designated by reference number 278 and is included to illustrate the working of variable potentiometer 280. Specifically, potentiometer 280 is equipped with a slideable resistance contact connected to pivotable arm 282 which is initially mechanically biased against spindles 88, 88' onto which the sheets are wound. The potentiometer 280 is coupled in series to the gearmotor 206 via leads 284 and is adapted so that as the diameter of the roll assembly 278 increases with increased number of sheets wound on the spindles, arm 282 pivots thus moving the contact means on the potentiometer 280 to increase the output resistance of the potentiometer 280 which will cause the rotation of the gearmotor output shaft to decrease. This decrease in the speed of the gearmotor as the diameter of the roll assembly increases can be effectively used to vary the interleaved and/or overlapped distances between successive sheets wound on the spindles as long as the sheets are fed to the folding station at a constant speed. It should be clear that if sheets are folded and advanced into the restrictive passage 60 at a constant speed and the speed of the guide and delivering means 12 is decreased, then the interleaved and/or overlapped distance of successive sheets will increase. Thus by decreasing the speed of gearmotor in proportion to the increase in the diameter of the roll assembly, the interleaved and/or overlapped distance for the initial sheets on the roll can be adjusted to be about 1 to 2 inches and increase to about 10 to 12 inches for the outer wound sheets on a roll containing about 40 sheets.

Figure 17:
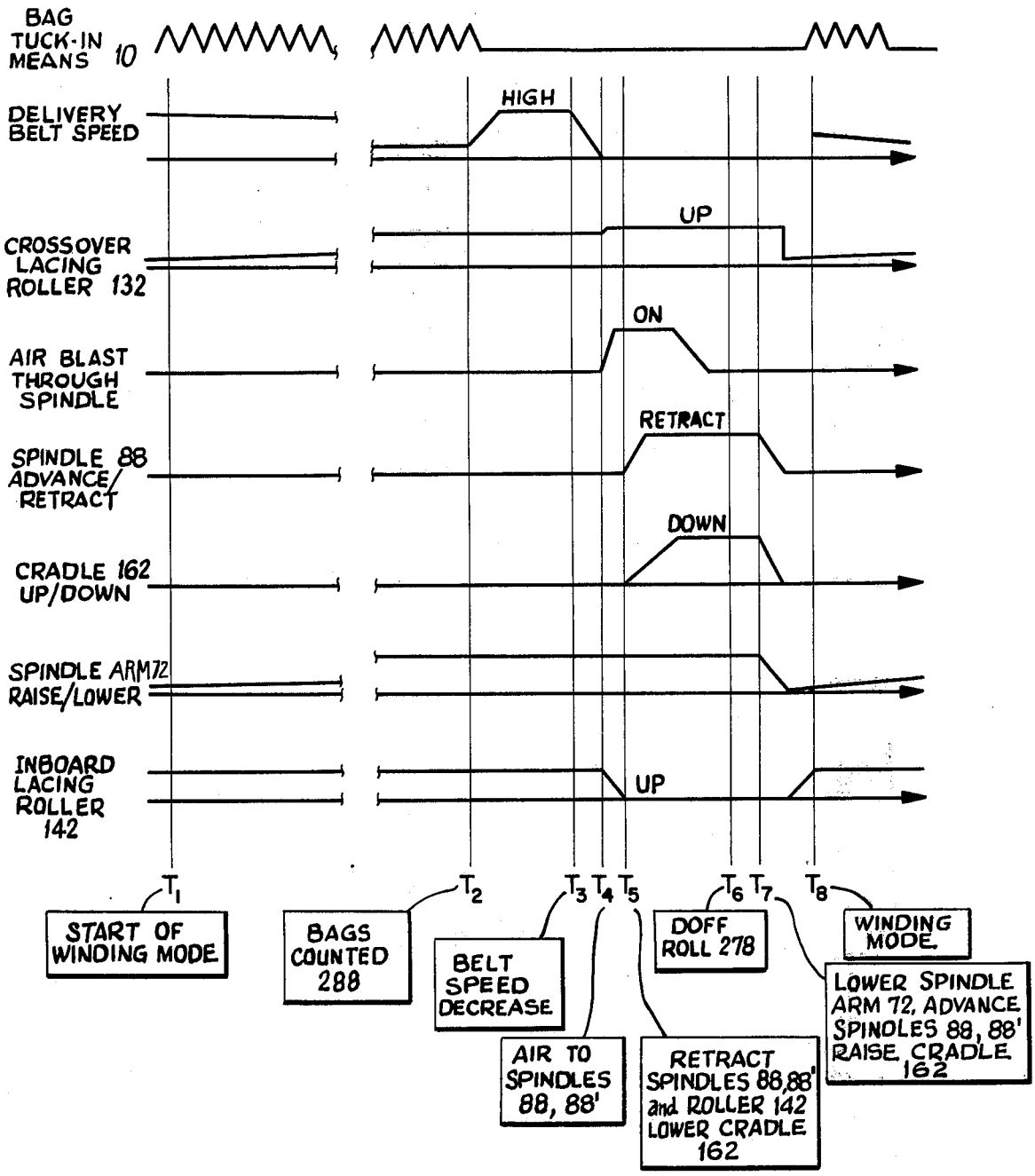
FIG. 17 is a timing diagram showing the sequence of operation of the various components of the coreless roll winding apparatus of FIG. 1.
Figure 18:
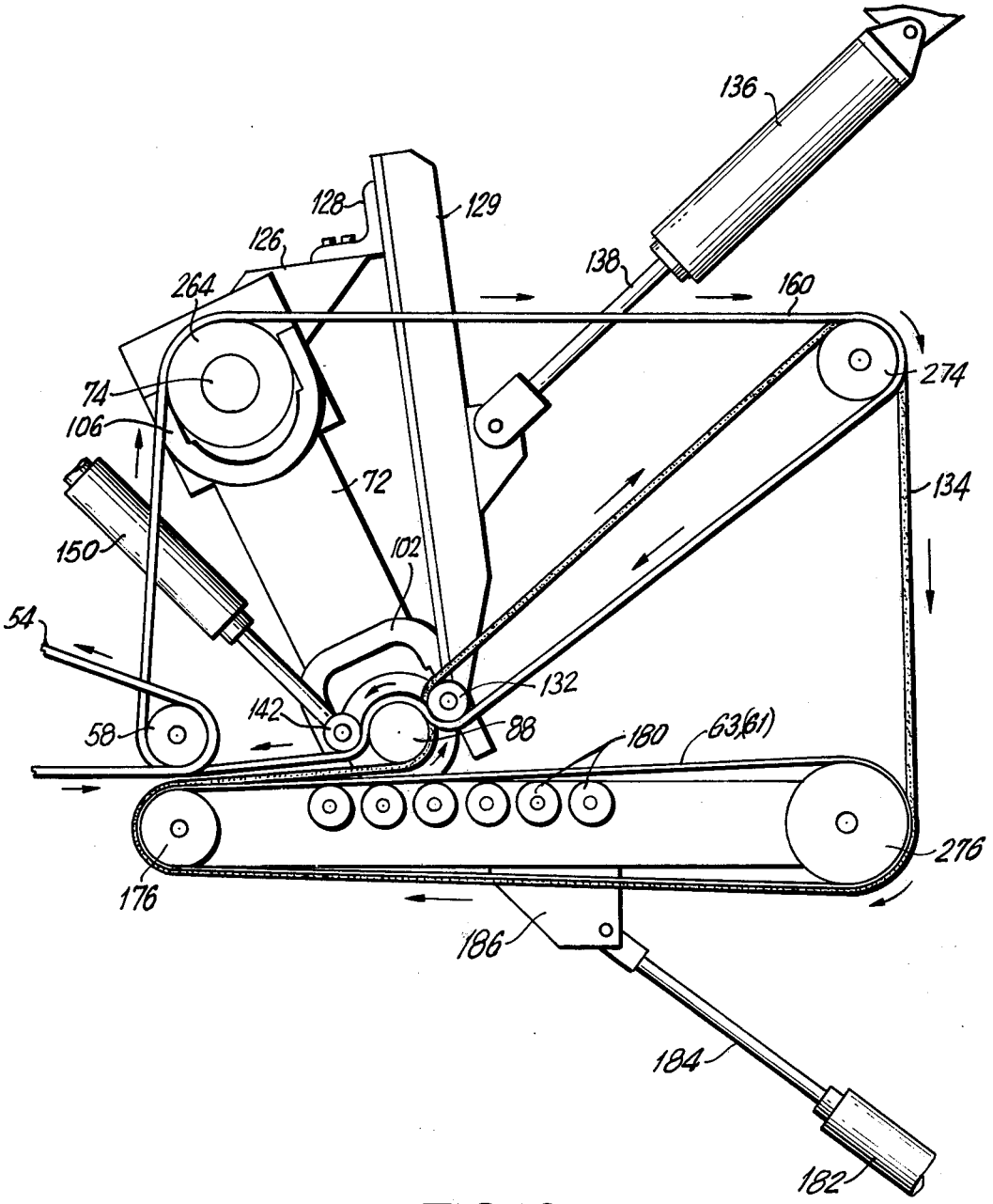
FIG. 18 is an enlarged end view of the winding spindle and related guide means shown just prior to the winding of a bag or the like around the spindle.

The sequential operation of the apparatus of this invention will be described in conjunction with FIGS. 2 and 16 through 20. FIGS. 18 through 20 have the same component parts and are identified with the same reference numbers as shown in FIGS. 1, 2 and 9 through 15. As shown in FIG. 17 at $T_1$ (Start of Winding Mode), the gearmotor 206 is turned on; the sheet tuck-in means is turned on; the crossover lacing guide roller 132 and the inboard lacing roller 142 are mechanically biased or urged against spindles 88, 88' which are in the winding position; and the cradle 162 is substantially horizontally disposed in the sheet roll assembly support position as generally shown in FIG. 18.

A sheet advancing from a feed supply to platform 28 trips a light beam of photo-cell 286 (FIG. 16) which in turn trips to start a predetermined count counter 288 and also transmits a signal to energize pneumatic valve vertically reciprocates knife 18 of the tuck-in means via reciprocating cylinder 24 as shown in $T_1$. Counter 288 is tripped one digit for each successive sheet interrupting the light beam of photo-cell 286. As a sheet is advanced over the throat 36, the tuck-in knife 18 folds and advances the folded end of the first sheet into the guiding and delivering station 12 whereupon the sheet is fed to the folding station 10 which is in the winding mode as shown in FIG. 18. With the first sheet substantially advancing through the guiding and delivering means as shown in FIG. 2, a second sheet is positioned over the trailing ends extended on platform 28 whereupon the tuck-in knife 18 contacts, folds and projects the folded end of the second sheet between the trailing end portions of the first sheet producing an interleaved arrangement as shown in FIG. 3. It is to be understood that the sheets do not have to be folded midway of their end extremities but could be folded such that the sheets in the roll could each have its folded end overlapping or superimposed on one of the trailing ends of the preceding sheet as shown in FIG. 3*c*.

To aid in the initial winding of sheets onto the spindles, a vacuum may be created at the ports 92 on the circumferential surface of the spindles which effectively adheres the first wind of a sheet to the spindles during the initial rolling operation.

As shown in FIG. 17, the above sequence of events continues until a predetermined number of sheets has interrupted the light beam of photo-cell 286 as, for example, as $T_2$ (Bags Counted). Thereafter the sheets are stopped from advancing to the tuck-in fold station 10. At and after $T_2$, the tuck-in knife 18 can be stopped or, optionally, it can continue to reciprocate since no new sheets are advanced to this station. At $T_2$ when the counter 288 has recorded a predetermined number of sheets, it triggers control unit 290 which in turn initiates the discharge mode of the apparatus. At $T_2$, the control unit transmits a signal via 294 to potentiometer 280 which causes its output resistance to decrease thereby effectively increasing the speed of gearmotor 206. This causes the trailing sheets in the guiding and delivering station 12 to be quickly wound around spindles 88, 88' to complete a sheet roll assembly 278 as shown in FIG. 19. At $T_3$ (Belt Speed Decrease) the speed of the gearmotor 206 can be decreased or even shut off, if desired. At $T_4$, (Air Blast to Spindle 88) the control unit 290 transmits a signal to energize solenoid operated pneumatic valves 296 and 300. Pneumatic valve 300 provides air pressure to air coupling 94, 94' and then through passage 90 to ports 92 of spindles 88, 88' so as to provide an air bearing layer between the outer surface of the spindles 88, 88' and the inner surface of the innermost wound sheet on the roll. Pneumatic valve 300 concurrently activates cylinder 150 to retract inboard guide roller 142 and related belts from the roll assembly 278. Pneumatic valve 296 pressurizes cylinder 136 to pivotally retract crossover roller 132 from the surface of the roll assembly 278. As crossover roller 132 swings up, it trips a pilot valve 302 which in turn pressurizes pilot operated pneumatic valve 298. At approximately $T_5$ (Retract Spindle 88, Roller 142 and Lower Cradle 162), pneumatic valve 198 pressurizes cylinders 114, 114' to retract spindle 88, 88' thus doffing the roll assembly 278 therefrom. Concurrently, pneumatic valve 298 reserves pressure on cylinder 182 to the lower cradle 162 to the doffing position as shown in FIG. 20 thereby permitting the roll assembly 278 at approximately $T_6$ (Doff Roll 278) to drop onto the doffing trough 304 shown in FIG. 1. A contact switch 306 (FIG. 1) could be disposed in trough 304 which would be tripped by roll assembly 278 to provide an electrical signal to control panel 290 at approximately $T_7$ (Spindle 88 Lowered and Advanced, Cradle 162 Raised) which deenergizes solenoid operated valves 296, and 300 to reverse the air cylinders associated with said valves thereby returning various component parts of the apparatus to the winding mode as illustrated at $T_8$ (Same as Start). As shown in FIG. 17, the spindle assembly should be advanced to the winding mode prior to advancing the inboard lacing roller 142 and crossover lacing guide roller 128 to the winding mode so as to facilitate the positioning of these components in a cooperative arrangement.

EXAMPLE 1

Using a coreless winding apparatus as substantially shown in the drawings, continuous coreless rolls of bags were produced, each roll containing about 40 separate bags. The bags were first folded longitudinally and then fed one at a time to the tuck-in station where each was folded midway between its closed end and open end. When approximately 2 inches of the trailing end of the first bag extended over the open end of the restrictive passage of the guiding and delivering station, the second bag was advanced over said passage and folded into the trailing end portions of the first bag thereby providing an interleaved distance of 2 inches as shown in FIG. 3. This procedure was continued and as the roll bag assembly increased, the speed of the gearmotor decreased thereby effectively causing the interleaved distance of succeeding adjacent bags to increase with the last bag being inserted into the trailing end portions of the penultimate bag a distance of 10 inches. Each roll assembly was doffed from the spindles easily and quickly. The procedure was continued until about 500 coreless rolls of bags were produced.

EXAMPLE 2

The assembly procedure of Example 1 was repeated except that the number of bags in each roll was reduced to 20. Again, no difficulty was encountered in producing the coreless roll assemblies.

EXAMPLE 3

The assembly procedure of Example 1 was repeated except that the speed of the gearmotor was held constant and the individual bags were not interleaved. The time for producing each coreless roll assembly was less than the time for producing a coreless roll assembly as discussed in Example 1 since the speed for winding the bags onto the spindles of the apparatus was not decreased due to the fact that adjacent bags on the roll were not interleaved. Again, no difficulty was encountered in producing the coreless roll assemblies.

It should be understood that the foregoing disclosure relates to preferred embodiments of the invention and it is intended to cover all changes and modifications of the invention which do not depart from the spirit and scope of the appended claims.

What is claimed is:

1. An apparatus for producing coreless roll assemblies of discrete sheets or strands comprising means for guiding and advancing the discrete sheets or strands to a roll winding station, said winding means comprising an axially translatable and rotatable spindle having at least one port in its circumferential surface adapted for coupling to a gas supply; translatable guide means adapted for substantially circumscribing said spindle and guiding and aiding the advancement of the successive sheets around said spindle; and means operable after a predetermined number of sheets are wound on said spindle for actuating a first means for disengaging said translatable guide means from about said sheet wound spindle, for actuating a second means for forcing gas out through said port in the spindle to provide a gas bearing layer thereat, and for actuating a third means for axially withdrawing the spindle from the bore of the wound sheet assembly thereby producing a coreless roll of successively wound discrete sheets.

2. The apparatus of claim 1 for rolling discrete and successive sheets of material into a colorless roll assembly wherein tuck-in means are added for folding successive sheets of material and guiding the folded end of each successive sheet into the means for guiding and advancing the folded sheets of material to a roll winding station.

3. The apparatus of claim 2 wherein the winding means comprises a pair of axially translatable and axially aligned spindles with each spindle having at least one port in its circumferential surface adapted for coupling to a gas supply.

4. The apparatus of claim 2 wherein the translatable guide means comprises a pair of driven belt means, each of which comprises a plurality of spaced-apart endless belts driven around rollers which are disposed such that the belts in each belt means are adapted to be urged against and ride about a portion of the circumference of the spindle so that together the belts of both belt means substantially circumscribe the spindle.

5. The apparatus of claim 4 wherein the winding means comprises a pair of axially translatable and axially aligned spindles with each spindle having at least one port in its circumferential surface adapted for coupling to a gas supply.

6. The apparatus of claim 2 wherein the means for guiding and advancing the folded sheets are nipper means comprising a pair of endless spaced-apart driven belts with the endless belts of the first driven belt means adapted for clockwise rotation while the endless belts of the second belt means adapted for counter-clockwise rotation with each of the belt means disposed so as to provide a restrictive passage having a first side wall defined by surfaces of the segments of the spaced-apart driven belts of the first belt means and a second side wall defined by surfaces of the segments of the spaced-apart driven belts of the second belt means with all the surfaces of the belt segments defining said restrictive passage moving in the same direction away from the top open end of the passage.

7. The apparatus of claim 6 wherein the winding means comprises a pair of axially translatable and axially aligned spindles with each spindle having at least one port in its circumferential surface adapted for coupling to a gas supply.

8. The apparatus of claim 6 wherein the tuck-in means comprises a reciprocable knife member disposed above the nipper means and operable such that when a sheet is positioned over the nipper means, the knife member will advance and contact the sheet somewhere between its extremities and proceed to initially fold the sheet about the contact area and then project the folded edge of the sheet into the nipper means.

9. The apparatus of claim 8 wherein the winding means comprises a pair of axially translatable and axially aligned spindles with each spindle having at least one port in its circumferential surface adapted for coupling to a gas supply.

10. The apparatus of claim 7 wherein the translatable guide means comprises a pair of driven belt means, each of which comprises a plurality of spaced-apart endless belts driven around rollers which are disposed such that the belts in each belt means are adapted to be urged against and ride about a portion of the circumference of the spindle so that together the belts of both belts means substantially circumscribe the spindle.

11. The apparatus of claim 10 wherein means are added to vary the speed of the driven belts of the nipper means, the driven belts of the translatable guide means and the rotation of the spindle of the winding means in relation to the diameter of a roll of sheets on said spindle such that as the diameter of the roll increases, the speed of said driven belts of the nipper means, said driven belts of the translatable guide means and the rotation of the spindle of the winding means decreases.

12. The apparatus of claim 2 wherein pivotable cradle means are added, said cradle means having a first position adapted for supporting a spindle mounted roll of sheets and having a second position for discharging and directing a fully wound roll assembly of sheets into a preselected receiving area.

13. The apparatus of claim 12 wherein the winding means comprises a pair of axially translatable and axially aligned spindles with each spindle having at least one port in its circumferential surface adapted for coupling to a gas supply.

14. The apparatus of claim 2 wherein means are added for maintaining a substantial constant tension on sheets being rolled on the spindle.

15. The apparatus of claim 10 wherein means are added for maintaining a substantial constant tension on sheets being rolled on the spindle.

16. A method for forming a self-sustaining coreless roll package of serially wound sheets in which the sheets can be removed from the center of the roll one at a time comprising the steps:

a. guiding and rolling a first and successive sheet about an axially translatable spindle thereby forming a roll of separable folded sheets on said spindle;
b. pressurizing the interface of the outer surface of the spindle and the inner surface of the innermost wound sheet; and
c. removing the spindle from the bore of the roll thereby producing a coreless roll of sheets.

17. The method of claim 16 wherein the following step precedes step (a):

a'. folding a first and then successive sheets between their outer end extremities and advancing and guiding the folded end of said first and succeeding sheets to a roll winding station.

18. A method for forming a strand of separable folded sheets into a self-sustaining coreless roll package in which the serially wound sheets can be dispensed from the center of the roll one at a time comprising the steps:

a. folding a first sheet between its outer end extremities and advancing the folded end of said first sheet to a roll winding station:
b. folding a second sheet between its outer end extremities and overlapping the folded end of the second sheet a unitary distance on at least one of the trailing end portions of said folded first sheet to form an overlapping arrangement;
c. folding, advancing and overlapping a predetermined number of succeeding sheets in a like manner into a strand of sheets;
d. guiding and rolling said strand about an axially translatable spindle thereby forming a roll of separable overlapped folded sheets; and
e. removing the spindle from the bore of the roll thereby producing a coreless roll of overlapped sheets.

19. The method of claim 18 wherein in step (c) the terminal sheet overlaps one of the trailing ends of the preceding sheet a distance greater than the overlapped distance between the first and second sheets, with the sheets intermediate the terminal and second sheets being overlapped incrementally increasing distances from the inner wound sheets to the outer wound sheets.

20. The method of claim 18 wherein in step (c) after a first predetermined number of succeeding sheets is overlapped to form a first strand portion, the following steps are added:

c'. folding, advancing and interleaving a succeeding sheet between the trailing end portions of the preceding sheet; an
c''. folding, advancing and interleaving a second predetermined number of succeeding sheets in a like manner to form a second strand portion.

21. The method of claim 20 wherein in step (c) the terminal sheet of the first predetermined number of the sheets overlaps one of the trailing ends of the preceding sheet a distance greater than the overlapped distance between the first and second sheets in said first strand portion, with the sheets intermediate the terminal and second sheets in said first strand portion being overlapped incrementally increasing distances from the inner wound sheets to the outer wound sheets; and wherein in step (c'') the terminal sheet of the second predetermined number of sheet is interleaved into the trailing ends of the preceding sheet a distance greater than the interleaved distance between the first and second sheets in said second strand portion, with the sheets intermediate the terminal and second sheets in said second strand portion being interleaved incrementally increasing distances from the inner wound sheets to the outer wound sheets.

22. A method for forming a strand of separable folded sheets into a self-sustaining coreless roll package in which the serially wound sheets can be dispensed from the center of the roll one at a time, comprising the steps:

a. folding a first sheet between its outer end extremities and advancing the folded end of said first sheet to a roll winding station;
b. folding a second sheet between its outer end extremities and interleaving the second folded end of the second sheet a unitary distance between at least the trailing end portions of said folded first sheet to form a separable strand of sheets;
c. folding, advancing and interleaving a predetermined number of succeeding sheets in a like manner into a strand of sheets;
d. guiding and rolling said strand about an axially translatable spindle thereby forming a roll of separable interleaved folded sheets; and
e. removing the spindle from the bore of the roll thereby producing a coreless roll of interleaved sheets.

23. The method of claim 22 wherein in step (c) the terminal sheet is interleaved between the trailing ends of the preceding sheet a distance greater than the interleaved distance between the first and second sheets, with the sheets intermediate the terminal and second sheets being interleaved incrementally increasing distances from the inner wound sheet to the outer wound sheet.

* * * * *